US007536131B2

(12) United States Patent
Kawai

(10) Patent No.: US 7,536,131 B2
(45) Date of Patent: May 19, 2009

(54) DEVELOPING DEVICE, IMAGE FORMING DEVICE AND METHOD OF ASSEMBLING DEVELOPING DEVICE

(75) Inventor: Hideaki Kawai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 422 days.

(21) Appl. No.: 11/550,435

(22) Filed: Oct. 18, 2006

(65) Prior Publication Data

US 2007/0122183 A1 May 31, 2007

(30) Foreign Application Priority Data

Nov. 29, 2005 (JP) ..... 2005-344682

(51) Int. Cl.
*G03G 15/08* (2006.01)

(52) U.S. Cl. ..... 399/105; 399/103

(58) Field of Classification Search ..... 399/103, 399/105, 267

See application file for complete search history.

(56) References Cited

U.S. PATENT DOCUMENTS 5,134,960 A * 8/1992 Shirai ..... 399/105
5,475,467 A 12/1995 Watanabe et al.
5,794,101 A 8/1998 Watanabe et al.
6,336,015 B1 * 1/2002 Numagami ..... 399/105 X
6,341,206 B1 * 1/2002 Yamaguchi et al. ..... 399/103
2004/0001727 A1 1/2004 Akutsu

FOREIGN PATENT DOCUMENTS

JP 03-073980 A 3/1991
JP 7-333988 A 12/1995
JP 2000-221777 A 8/2000
JP 2003-162147 A 6/2003
JP 2004-317643 A 11/2004

OTHER PUBLICATIONS

Official communication issued in the counterpart European Application No. 06019368.7, mailed on Apr. 18, 2007.
Official communication issued in counterpart Japanese Application No. 2005-344682, mailed on Mar. 10, 2009.

* cited by examiner

*Primary Examiner*—Sandra L Brase
(74) *Attorney, Agent, or Firm*—Keating & Bennett, LLP

(57) ABSTRACT

A developing device includes a sealing member for sealing an end of a developing roller to prevent developer from leaking from the interior of a casing. The casing includes a first plane and a second plane. A blade is mounted to the first plane and the blade regulates the amount of developer on the developing roller. The second plane is positioned upwardly of the first plane. The sealing member is positioned so that an end surface is located between the first plane and the second plane, and is mounted to the casing. The blade is mounted so as to press the end surface of the sealing member.

19 Claims, 7 Drawing Sheets

DEVELOPING DEVICE, IMAGE FORMING DEVICE AND METHOD OF ASSEMBLING DEVELOPING DEVICE

BACKGROUND OF THE INVENTION

1. Field of Invention

The present invention relates to a developing device, an image forming device, and a method of assembling the developing device. More specifically, the present invention relates to a structure in which a sealing member is mounted for preventing leaking of developer from both ends of a developing roller.

2. Description of the Related Art

A prior art image forming device of an electrophotography system is mounted to a printer, a multi function peripheral, a facsimile machine and so on. An electrostatic latent image formed on a photosensitive drum is developed by a developing device having developer (toner or the like) stored therein to form a toner image. A transfer device transfers the toner image onto a recording paper. A fusing device fuses the transferred toner image on the recording paper.

In the developing device in the image forming device as described above, a magnet roller as a developing roller is inserted into a developing sleeve. The developing sleeve is rotatably supported by a casing. The magnet roller is fixed to the casing. The developing sleeve is rotated relative to the magnet roller. For example, in the developing device having a two-component developer stored therein, the developer is adhered to the outer surface of the developing sleeve to form a magnetic brush. Toner particles are transferred from the magnetic brush to the outer surface of the photosensitive drum by static electricity, and an electrostatic latent image on the photosensitive drum is developed into the toner image.

In general, in the developing device, a sealing member is adhered to the inner wall of the casing and the developing sleeve slides in tight contact with the sealing member. Therefore, leaking of the developer from the interior of the casing to the side is prevented. More specifically, a blade is provided on the developing device, and the blade cuts bristles of a carrier nap. One end surface of the sealing member is pressed against the blade. Therefore, the outer side surface of the sealing member is brought into tight contact with an inner wall of the casing, and an end of the developing roller is sealed. When the end surface of the sealing member is located downwardly of a blade mounting surface at the time of assembly of the developing device, the back surface of the blade and the end surface of the sealing member are spaced apart. In this case, in which the developer may leak, the blade mounting surface is defined as a reference plane of the lower limit of the position of the end surface of the sealing member in the prior art.

In the developing device in the prior art, a sealing member having a C-shape in cross-section is fixed to the inner wall of the casing. An inclined surface which inclines upward with respect to a mounting surface for mounting the sealing member is formed on the inner wall of the casing. A ridgeline of the inclined surface is defined as a reference of the mounting position to mount the end surface of the sealing member.

However, in the developing device in the prior art, the reference plane of the end surface of the sealing member as the upper limit is not defined. Therefore, determining the proper position of the end surface of the sealing member upward with respect to the lower limit reference plane largely depends on the skill of an operator. When the developing device is assembled by an inexperienced operator, the end surface of the sealing member projects significantly upward from the blade mounting surface. In this case, since the sealing member is bent when being pressed by the blade, there is a problem that a gap is formed between the sealing member and the inner wall of the casing. In this manner, in the developing device in the prior art, positioning of the sealing member is liable to vary. Therefore, the assembling accuracy of the developing device is deteriorated, and hence assembly efficiency is low.

SUMMARY OF THE INVENTION

In order to overcome the problems described above, preferred embodiments of the present invention relate to a developing device, an image forming device, and a method of assembling the developing device. Therefore, the positioning of a sealing member is facilitated, and leaking of developer from the interior of a casing is reliably prevented. The assembling accuracy of the developing device is also improved.

The present invention relates to a developing device. The developing device includes a casing, a developing roller, and a sealing member. The sealing member seals an end of the developing roller to prevent leaking of developer from the interior of the casing. The casing includes a first plane and a second plane. A blade is mounted along the first plane and the blade regulates the amount of developer on the developing roller. The second plane is positioned upwardly of the first plane. The sealing member is positioned so that the end surface (the end surface of the sealing member) is located between the first plane and the second plane. The blade is mounted so as to press the end surface of the sealing member.

According to the preferred embodiments of the present invention, accurate positioning of the sealing member is facilitated. Then the leaking of the developer from the interior of the casing is reliably prevented and the assembling accuracy is improved.

According to a preferred embodiment of the present invention, the first plane and the second plane are provided adjacent to a holder for mounting the sealing member.

According to another preferred embodiment of the present invention, positioning of the sealing member can be done easily by an inexperienced operator. Therefore, variation in assembling accuracy is reduced and the assembling efficiency is improved.

According to another preferred embodiment of the present invention, the second plane is formed on the upper surface of a rib provided on the casing.

According to another preferred embodiment of the present invention, the casing of the present preferred embodiment is preferably molded by simply adding to a configuration of the prior art casing. The number of parts is prevented from increasing and the manufacturing cost can be reduced.

The present invention also relates to a method of assembling the developing device including a sealing member for preventing leaking of developer from the interior of a casing by sealing an end of a developing roller. The casing includes a first plane and a second plane. A blade is mounted along the first plane, and the blade regulates the amount of developer on the developing roller. The second plane is positioned upwardly of the first plane. The assembling method includes a step of positioning the sealing member so that the end surface thereof is located between the first plane and the second plane, and a step of mounting the blade so as to press the end surface of the sealing member.

According to the preferred embodiments of the present invention, positioning of the sealing member is facilitated. The leakage of developer from the interior of the casing is reliably prevented. The assembling accuracy is also improved.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
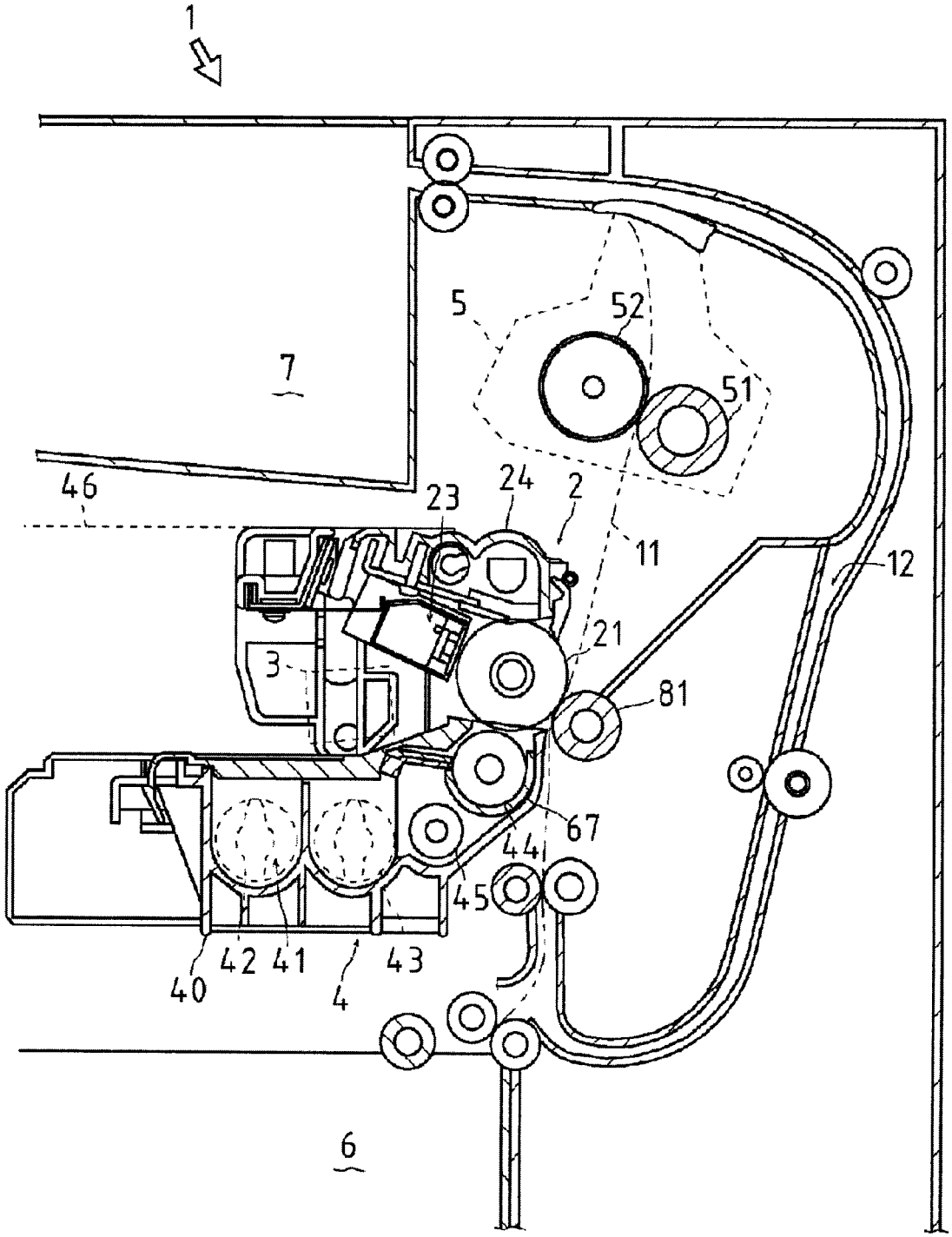
FIG. 1 is a front cross-sectional view showing a general configuration of an image forming device provided with a developing device according to a preferred embodiment of the present invention.
Figure 2:
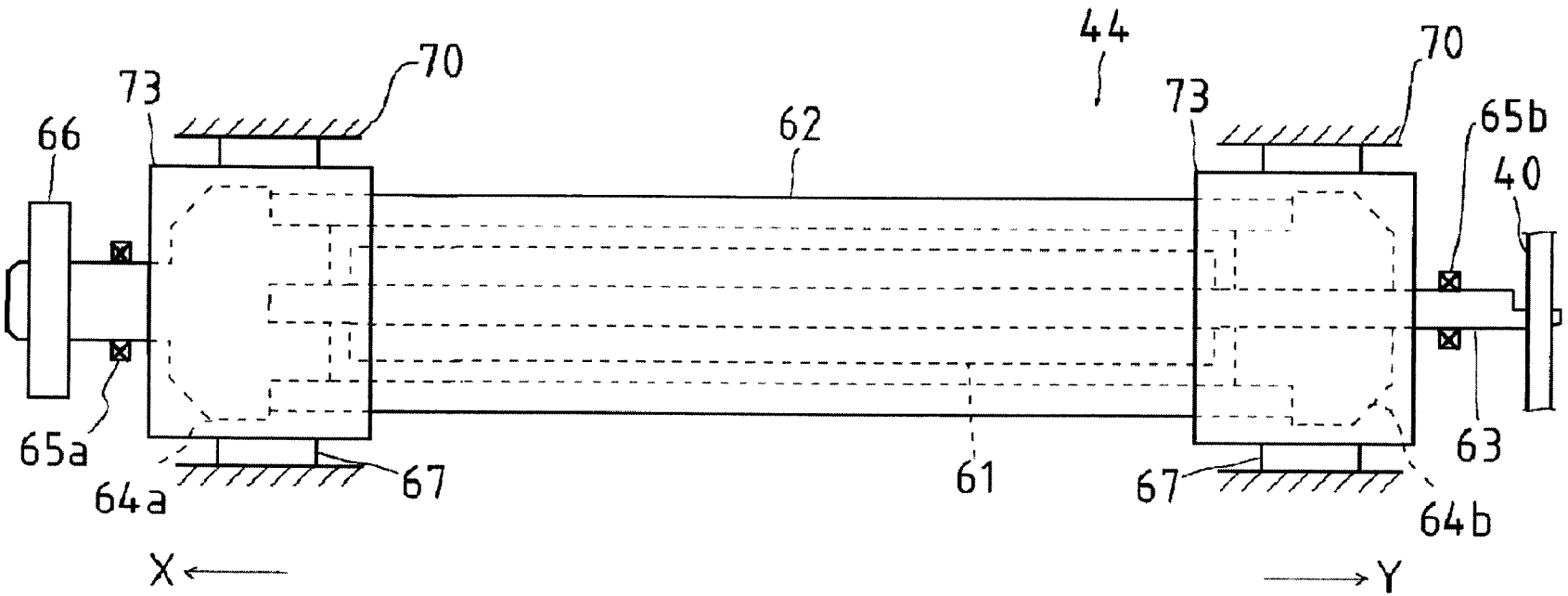
FIG. 2 is a plan view showing a configuration of a developing roller.
Figure 3:
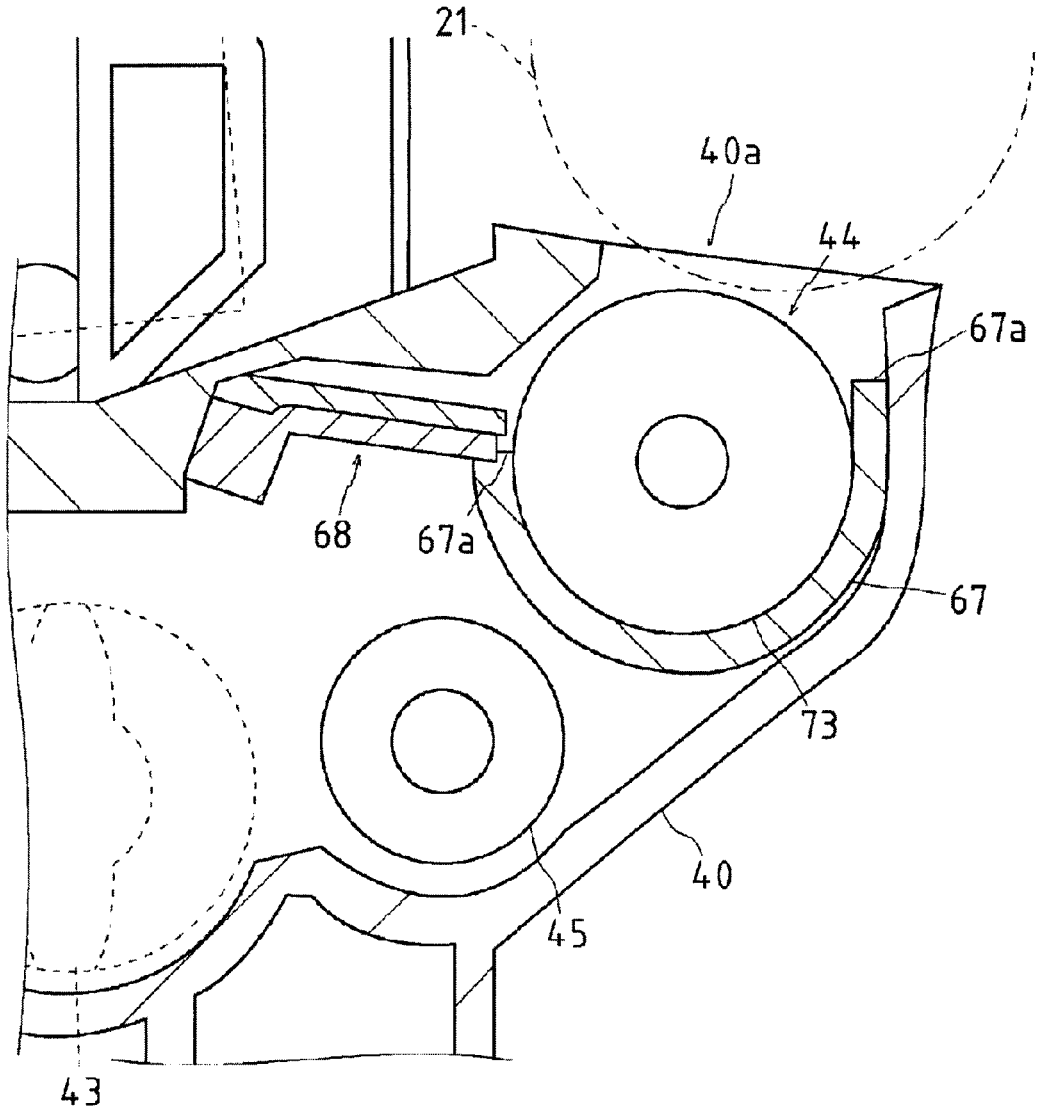
FIG. 3 is a front cross-sectional view of the developing device showing a layout of the developing roller and a sealing member.
Figure 4:
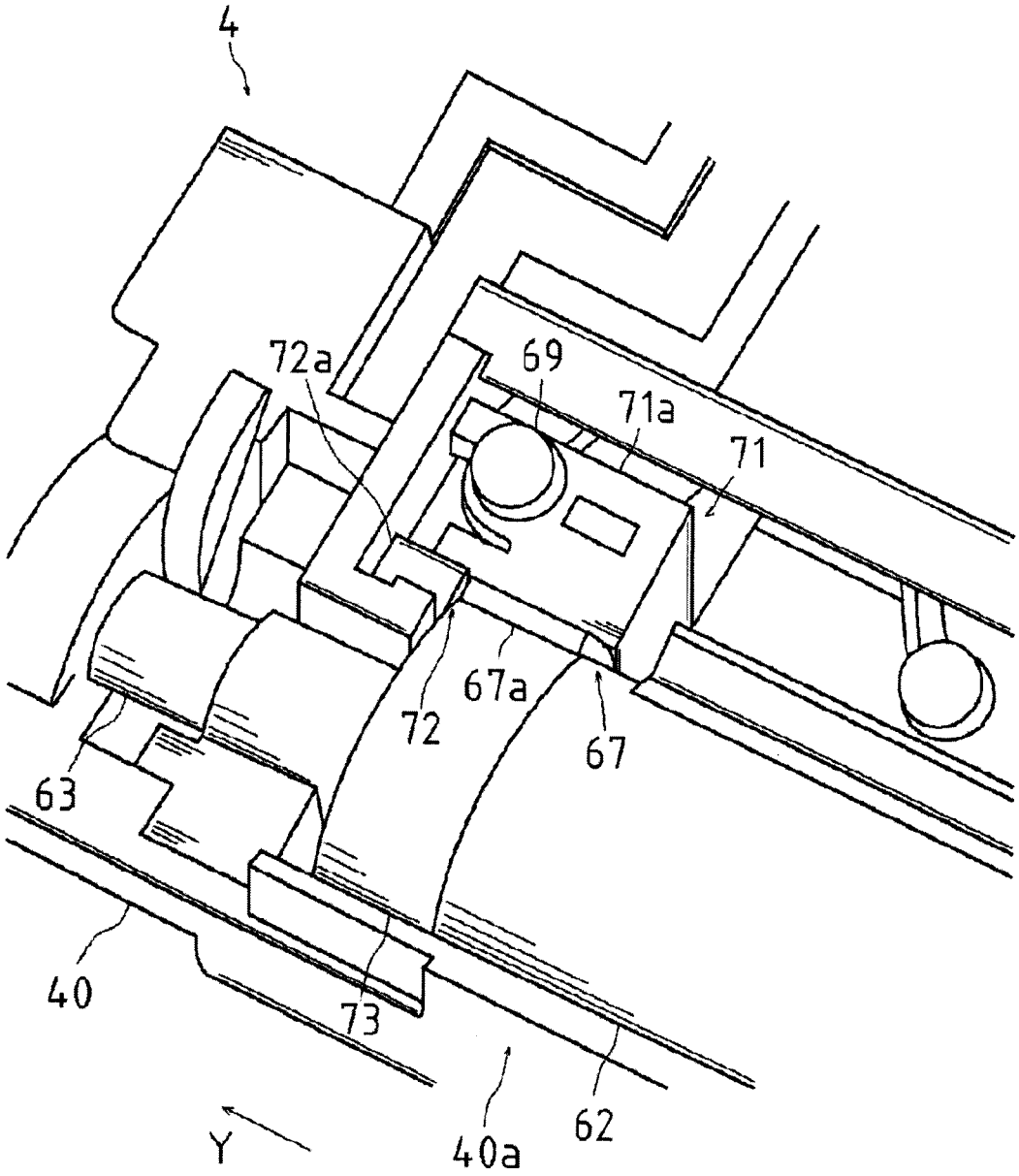
FIG. 4 is a perspective view of a mounting structure of the sealing member.
Figure 5:
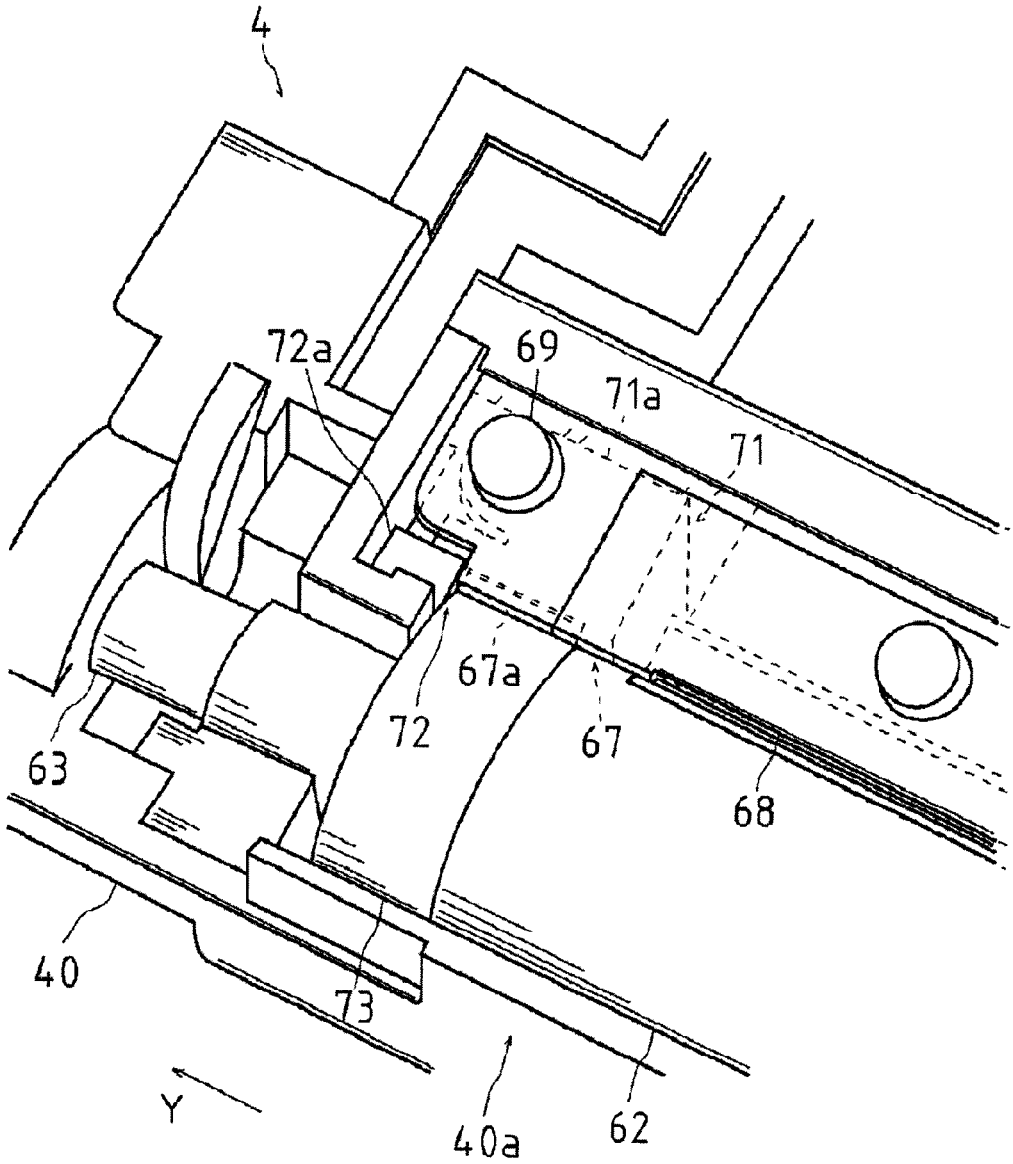
FIG. 5 is a perspective view of FIG. 4 with a blade mounted thereon.
Figure 6:
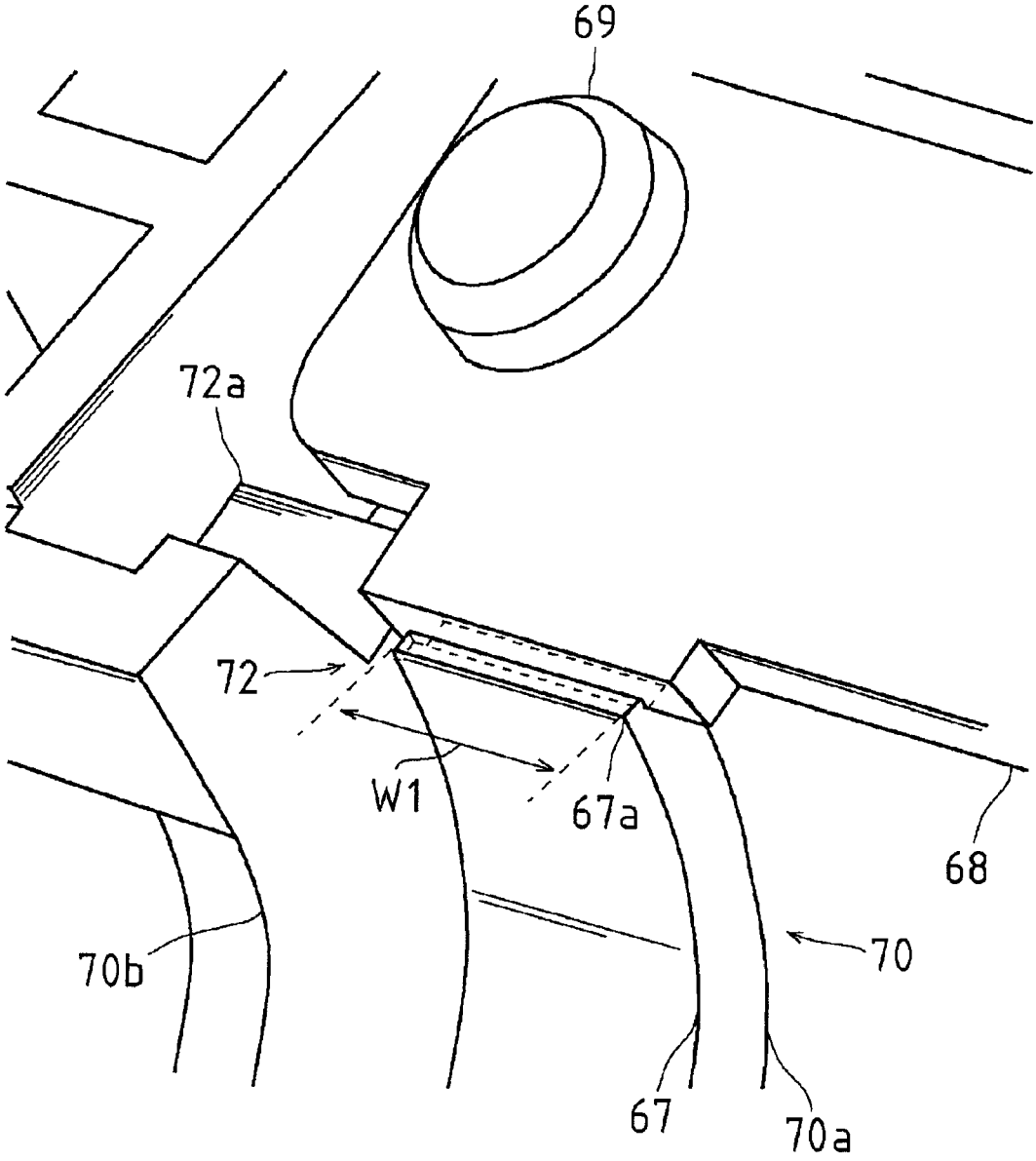
FIG. 6 is an enlarged perspective view of a mounting structure of the sealing member.
Figure 7:
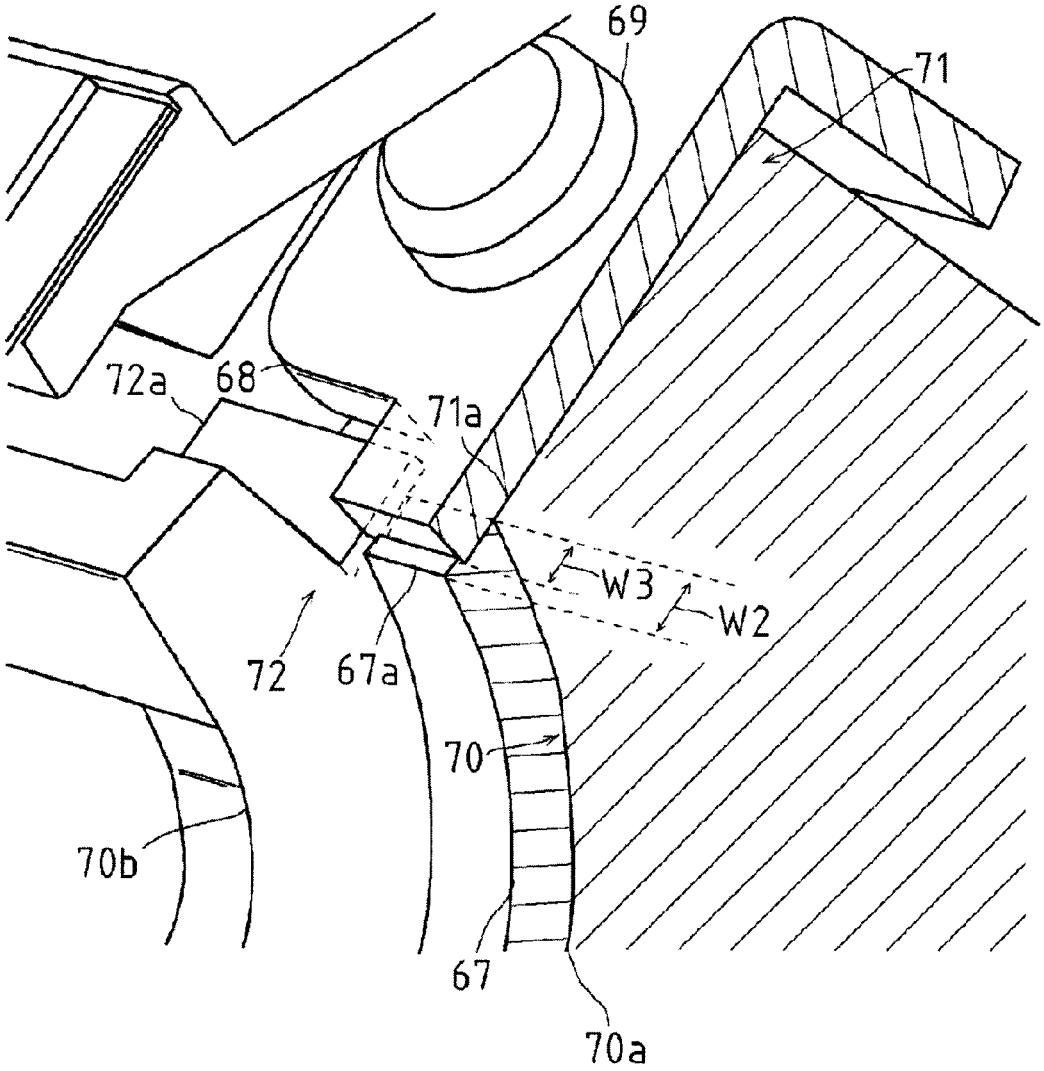
FIG. 7 is an enlarged perspective view of a portion of FIG. 6.

FIG. 1 is a front cross-sectional view showing a general configuration of an image forming device provided with a developing device according to a preferred embodiment of the present invention. FIG. 2 is a plan view showing a configuration of a developing roller. FIG. 3 is a front cross-sectional view of the developing device showing a layout of the developing roller and a sealing member. FIG. 4 is a perspective view of a mounting structure of the sealing member. FIG. 5 is a perspective view of FIG. 4 with a blade mounted thereon. FIG. 6 is an enlarged perspective view of a mounting structure of the sealing member. FIG. 7 is an enlarged perspective view of a portion of FIG. 6 in cross-section.

A general configuration of an image forming device 1 having a developing device 4 according to the present preferred embodiment will be described below. As shown in FIG. 1, the image forming device 1 is arranged above a paper feed cassette 6. A toner image as visualized image information is transferred to a recording paper picked up from the paper feed cassette 6. The recording paper on which the toner image is fused is discharged to a paper output tray 7 via a main transportation path 11. The paper output tray 7 is provided in the upper portion of the image forming device 1. A reverse transportation path 12 is arranged on the outside of the main transportation path 11. The reverse transportation path 12 is used for duplex printing. The reverse transportation path 12 diverges from the main transportation path 11 and is rejoined thereto. A photosensitive drum unit 2, an exposure device 3, the developing device 4, and a fusing device 5 are arranged along the main transportation path 11.

A photosensitive drum unit 2 includes a photosensitive drum 21, a charger 23, and a cleaning device 24. The charger 23 charges the surface of the photosensitive drum 21. The cleaning device 24 cleans the surface of the photosensitive drum 21. A laser beam from an exposure head (not shown) of the exposure device 3 passes through a gap between the charger 23 and the developing device 4 and irradiates the outer surface of the photosensitive drum 21. Accordingly, an electrostatic latent image is formed on the surface of the photosensitive drum 21. In the present preferred embodiment, the photosensitive drum unit 2 is a unit including the photosensitive drum 21 and the charger 23 integrally assembled to each other.

Alternatively, the exposure device 3 may use an LED head as an exposure head. The LED head includes linearly arranged light emitting points. The LED head exposes the outer surface of the photosensitive drum 21 charged by the charger 23 on the basis of digital image information. Accordingly an electrostatic latent image is formed on the outer surface of the photosensitive drum 21.

The developing device 4 includes a casing 40, a stirring chamber 41, stirring members 42, 43, a developing roller 44, and a transportation roller 45. The casing 40 accommodates a two-component developer including toner and carrier. The stirring chamber 41 is formed by dividing the interior of the casing 40 into a plurality of divisions. The stirring members 42, 43 stir the two-component developer in the stirring chamber 41. The developing roller 44 supplies the two-component developer supplied from the stirring members 42, 43 to the photosensitive drum 21. The transportation roller 45 supplies the two-component developer from the stirring members 42, 43 to the developing roller 44. A toner chamber 46 is connected to the developing device 4. Toner is replenished from the toner chamber 46 to the stirring chamber 41.

In the present preferred embodiment, the photosensitive drum unit 2 is connected and fixed to the upper portion of the developing device 4, so that the developing device 4 and the photosensitive drum unit 2 are an integral unit. At this time, the outer surfaces of the developing roller 44 and the photosensitive drum 21 oppose each other. The unit can be inserted into and pulled out from the front side of the device in a direction that is substantially perpendicular to the main transportation path 11. A detailed description of the developing device 4 will be given below (see FIG. 2 and FIG. 3).

The outer surfaces of the photosensitive drum 21 and a transfer roller 81 are arranged with the main transportation path 11 interposed therebetween, thereby forming a nip. In the main transportation path 11, the recording paper passed through the position where the developing device 4 is disposed is fed into the nip. A transfer process is performed by the transfer roller 81. In other words, since a bias voltage is applied to the transfer roller 81 on the back side of the recording paper which is in tight contact with the photosensitive drum 21, toner is transferred from the photosensitive drum 21 to the recording paper. In the main transportation path 11, the recording paper to which toner is transferred is fed downstream to the fusing device 5.

The fusing device 5 is a unit including a heat roller 52 and a press roller 51. The press roller 51 is disposed so as to be in pressing contact with the outer surface of the heat roller 52 with the main transportation path 11 interposed therebetween. In the fusing device 5, the recording paper on which the toner is transferred is fed into a nip between the heat roller 52 and the press roller 51. The recording paper is heated and pressed in the nip and the toner image on the recording paper is fused.

The developing device 4 in the present preferred embodiment will be described in detail below. As shown in FIG. 2 and FIG. 3, the developing device 4 in the present preferred embodiment includes the casing 40, the stirring chamber 41, the stirring members 42, 43, the developing roller 44, and the transportation roller 45 as described above. In the developing roller 44, a magnet roller 61 having a plurality of magnetic poles is inserted into a developing sleeve 62. The developing sleeve 62 is rotated relative to the magnet roller 61. Therefore, the developer held on the outer surface of the developing sleeve 62 is transported.

In the description regarding the developing device 4 in FIG. 2, an end located on the rear side in a state of being inserted into a main body of the image forming device 1 is referred to as a rear end X, and an end located on the front side of the image forming device 1 is referred to as a front end Y of the image forming device 1.

In the casing 40, the side opposing the photosensitive drum 21 is open. The developing roller 44 is arranged in an opening 40*a*, and the outer surface of the developing sleeve 62 opposes the surface of the photosensitive drum 21. The two-component developer is stored in the casing 40. The developer is a mixture of magnetic carrier and non-magnetic toner. The toner is supplied from the toner chamber 46 to the casing 40.

The stirring members 42, 43 stir the developer stored in the stirring chamber 41 of the casing 40. The stirring members 42, 43 also transport the developer to the transportation roller 45. In the interior of the casing 40, the stirring chamber 41 is divided into a plurality of divisions. The stirring members 42, 43 are arranged at substantially the center of the respective divisions of the stirring chamber 41. Shafts of the stirring members 42, 43 are rotatably supported by the casing 40. Screws are mounted respectively to the shafts. The developer in the casing 40 is stirred and transported by the screws. When the developer is stirred by the stirring members 42, 43, carrier and toner are brought into frictional contact, and hence the toner is electrically charged, whereby the carrier and the toner are electrostatically adhered to each other.

The developing sleeve 62 is formed of a conductive material such as aluminum. The cylindrical magnet roller 61 fixed coaxially with the sleeve 62 and a fixed shaft 63 as a center axis of rotation integral with the magnet roller 61 are provided in the interior of the developing sleeve 62. The fixed shaft 63 partially projects in the longitudinal direction thereof from a longitudinal end of the developing sleeve 62. The magnet roller 61 is shorter than the developing sleeve 62 and is stored in the interior space of the developing sleeve 62 in the entire length thereof.

At the longitudinal ends of the developing sleeve 62, a flange 64*a* is fixed integrally with the fixed shaft 63, and a flange 64*b* is rotatably supported by the fixed shaft 63. The flanges 64*a*, 64*b* have a shape so as to be positioned outside both of the longitudinal ends of the developing sleeve 62. The flanges 64*a*, 64*b* are supported by bearings 65*a*, 65*b* outside the longitudinal ends of the developing sleeve 62. Cap members 73, 73 are mounted to the respective both ends of the developing sleeve 62 so as to cover the flanges 64*a*, 64*b*.

At one end of the developing roller 44, that is, at the rear end X, the flange 64*a* protrudes outwardly of the casing 40 with respect to the bearing 65*a*. A sleeve gear 66 is fixed to the protrusion. At the other end of the developing roller 44, that is, at the front end Y, the fixed shaft 63 protrudes outwardly of the casing 40 with respect to the bearing 65*b*. The fixed shaft 63 is fixed to the side wall of the casing 40. A drive force from a motor provided on the main body of the device is transmitted to the sleeve gear 66, and the developing sleeve 62 rotates clockwise in FIG. 1.

The transportation roller 45 is arranged between the stirring member 43 and the developing sleeve 62. The developer transported by the stirring member 43 is supplied to the outer surface of the developing sleeve 62 by the transportation roller 45. More specifically, the transportation roller 45 is rotatably supported by the casing 40. When the transportation roller 45 is rotated, the developer held on the outer surface of the transportation roller 45 is transferred over to the outer surface of the developing sleeve 62.

A developing process carried out by the developing device 4 will be described. Firstly, the developer is adhered and held to the outer surface of the developing sleeve 62 by a magnetic force of the magnet roller 61. Then, a magnetic brush is formed. The developing sleeve 62 is rotated clockwise in FIG. 3. The brush-like developer is held on the outer surface of the developing sleeve 62. The developer is moved to the position between the developing sleeve 62 and the photosensitive drum 21. The toner is attached to the carrier attached to the outer surface of the developing sleeve 62. The toner is moved to the electrostatic latent image on the photosensitive drum 21 by an electric field formed between the developing sleeve 62 and the electrostatic latent image on the photosensitive drum 21. Then, the toner is attached to the electrostatic latent image to form the toner image.

A mounting structure of a sealing member 67 will be described below. As shown in FIG. 3 to FIG. 7, in the developing device 4 in the present preferred embodiment, the developing roller 44 (including developing sleeve 62) is supported by the casing 40 so as to be capable of rotating. The cap members 73 are in tight contact with the sealing members 67 at both ends of the developing roller 44. The sealing members 67 are mounted to the casing 40. In this configuration, leaking of the developer from the stirring chamber 41 at both ends of the developing roller 44 is prevented. The same sealing members 67 are mounted respectively to the rear end X and the front end Y of the developing roller 44 in the same manner. The sealing member 67 provided on the front end Y of the device and the mounting structure thereof will be described below unless otherwise specifically described.

In the developing device 4, the inner wall of the casing 40 is provided with a holder 70, a blade mounting member 71, and a rib 72. The sealing member 67 is adhered and fixed to the holder 70. The blade mounting member 71 is adjacent to the holder 70, and a blade 68 is mounted thereto. The blade 68 regulates the amount of the developer on the developing roller 44 (the developing sleeve 62). The rib 72 is adjacent to the holder 70 and the blade mounting member 71.

The sealing member 67 is preferably formed of a material having superior sealing properties, such as a sponge material. The sealing member 67 is formed into a substantially C-shape in side view, and extends along the circumferential surface of the cap member 73 mounted to the developing roller 44. In this manner, with the configuration of the sealing member 67 as described above, the sealing member 67 does not hinder a removing operation of the developing roller 44 from the casing 40. Since the circumferential surface of the cap member 73 comes into tight contact with the inner surface of the sealing member 67, the sealing member 67 is positioned and fixed stably in the radial direction. The opening end of the sealing member 67 is directed toward the opening 40*a* of the casing 40 at a position opposing the cap member 73. The sealing member 67 is adhered and fixed to the inner wall (holder 70) of the casing 40. End surfaces 67*a*, 67*a* are respectively provided at the opening ends of the sealing member 67.

The holder 70 is a portion of the inner wall of the casing 40 formed to have a curved surface 70*a* of a substantially C-shape configuration in side view in the same manner as the sealing member 67, and the outer side surface of the sealing member 67 is tightly adhered and fixed to the curved surface 70*a* (see FIG. 6 and FIG. 7). A side wall 70*b* integrally formed with the inner wall of the casing 40 is provided with the holder 70 outside of the device, and a side surface of the sealing member 67 outside of the device is in tight contact with the side wall 70*b* in the state in which the sealing member 67 is mounted to the holder 70. The holders 70 are provided at positions opposing the cap members 73, respectively, as described above.

The blade mounting member 71 is adjacent to the curved surface 70*a* of the holder 70. The blade mounting member 71 is arranged on the rear side of the device when viewed from the opening 40*a* on the casing 40. A first plane 71*a* is formed by the upper surface of the blade mounting member 71. The blade 68 is mounted along the first plane 71*a*. The blade 68 placed on the first plane 71*a* is secured by a bolt 69 (see FIG. 5 to FIG. 7). In addition to the configuration in which a single blade mounting member 71 is provided adjacent to the holder 70, a plurality of blade mounting members 71 may be provided along the longitudinal direction of the device.

The blade 68 regulates the height of the magnetic brush (nap) formed on the developing roller 44. More specifically, the blade 68 has a longitudinal plate shape which is longer than the longitudinal length of the developing roller 44 in plan view. The blade 68 is fixed to the blade mounting member 71 described above along the longitudinal direction of the developing device 4 with the bolt 69. The blade 68 is arranged upstream in the direction of rotation of the developing roller 44 viewed from a position near the developing roller 44 and the photosensitive drum 21. The end of the blade 68 protrudes from the edge of the blade mounting member 71 (first plane 71*a*) toward and close to the outer surface of the developing roller 44.

The rib 72 is adjacent to the curved surface 70*a* of the holder 70. The rib 72 is disposed outside the device with respect to the holder 70 (the direction of the front end Y of the device in FIG. 4 and FIG. 5). The rib 72 is formed by the inner wall of the casing 40 projecting upward at a position which does not get in the way of the sealing member 67 mounted on the holder 70 or the blade 68 mounted to the blade mounting member 71. A second plane 72*a* is formed by the upper surface of the rib 72. The second plane 72*a* is arranged to be substantially parallel with and above the first plane 71*a* described above.

The positional relation among the holder 70, the blade mounting member 71, and the rib 72 will be described. In the casing 40, the position to dispose the holder 70 is determined by the configuration of the cap member 73 or the like of the developing roller 44. The blade mounting member 71 is disposed with respect to the holder 70 such that the first plane 71*a* is located at an end of the curved surface 70*a*. The rib 72 is disposed such that the side wall of the rib 72 opposes the holder 70, and the second plane 72*a* is formed so as to be substantially parallel with and above the first plane 71*a*. In this manner, in the developing device 4, the first plane 71*a*, and the second plane 72*a* are arranged adjacent to the holder 70.

In order to assemble the developing device 4 in the present preferred embodiment, at least two steps are required. The first step is positioning one of the end surfaces 67*a* of the sealing member 67, more specifically, the end surface 67*a* arranged on the rear side of the device viewed from the opening 40*a* when being mounted to the holder 70. The second step is mounting the blade 68 to the blade mounting member 71 so as to press the end surface 67*a* of the sealing member 67 mounted to the holder 70.

The sealing member 67 is firstly positioned so that the end surface 67*a* is located at least upwardly of the first plane 71*a*. In other words, the first plane 71*a* of the present preferred embodiment corresponds to the lower limit reference plane for locating the lower limit position of the end surface 67*a* when mounting the sealing member 67 to the holder 70, and serves as a mark. In other words, the first plane 71*a* is a surface which indicates the lowermost position of the end surface 67*a* which does not generate a gap between the bottom surface of the blade 68 and the end surface 67*a* of the sealing member 67 when mounting the blade 68 to the blade mounting member 71 in a state in which the sealing member 67 is mounted to the holder 70.

In this manner, in the state in which the sealing member 67 is mounted to the holder 70, at least the end surface 67*a* is positioned upwardly of the first plane 71*a*. Therefore, when the blade 68 is mounted to the blade mounting member 71, the end surface 67*a* is pressed by the bottom surface of the blade 68. Consequently, the sealing member 67 comes into tight contact with the curved surface 70*a* of the holder 70.

The sealing member 67 is positioned so that the end surface 67*a* is located at least downwardly of the second plane 72*a*. In other words, the second plane 72*a* in the present preferred embodiment corresponds to the upper limit reference plane for locating the upper limit position of the end surface 67*a* when mounting the sealing member 67 to the holder 70, and serves as a mark. In the present preferred embodiment, when mounting the blade 68 to the blade mounting member 71 in a state in which the sealing member 67 is mounted to the holder 70, the end surface 67*a* of the sealing member 67 may be pressed by the blade 68. In this case, even when the sealing member 67 is deflected, a gap is not formed between the blade 68 and the end surface 67*a*, or between the outer side surface of the sealing member 67 and the curved surface 70*a*. In other words, the second plane 72*a* corresponds to a plane which indicates the uppermost position where the end surface 67*a* can be located.

When mounting the sealing member 67 to the holder 70, one of the end surfaces 67*a* is positioned upwardly of the first plane 71*a*. In association with this, one of the end surfaces 67*a* is positioned downwardly of the second plane 72*a*. In other words, the sealing member 67 is positioned so that the end surface 67*a* is located between the first plane 71*a* and the second plane 72*a*. More specifically, the sealing member 67 is moved upward and downward along the curved surface 70*a* of the holder 70 in the circumferential direction. Accordingly, a longitudinal side W1 of the end surface 67*a* is positioned by the operator with respect to the first plane 71*a* (see FIG. 6), that is, above the first plane 71*a*. A short side W2 of the end surface 67*a* is positioned by the operator with respect to the second plane 72*a* (see FIG. 7), that is, below the second plane 72*a*.

The outer side surface of the sealing member 67 mounted to the holder 70 in this manner is brought into tight contact with the curved surface 70*a* of the holder 70. In association with this, the side surface of the sealing member 67 is brought into tight contact with, adhered to, and fixed to the side wall 70*b* of the holder 70. The developing roller 44 is rotatably supported by the casing 40 in a state in which the sealing member 67 is mounted to the holder 70. Then, the blade 68 is mounted along the first plane 71*a* of the blade mounting member 71.

The blade 68 projects from the blade mounting member 71 (first plane 71*a*). In association with this, the end surface 67*a* of the sealing member 67 is positioned upwardly of the first plane 71*a* as described above. Therefore, the bottom surface of the projecting end of the blade 68 comes into abutment with the end surface 67*a* of the sealing member 67 on the rear side of the device. However, in the present preferred embodiment, a projecting width W3 of the blade 68 along the first plane 71*a* is smaller than the short side W2 of the end surface 67*a*. Therefore, the portion of the end surface 67*a* which overlaps with the blade 68 is compressed (see FIG. 6 and FIG. 7). In other words, in a state in which the blade 68 is completely fixed along the first plane 71*a*, the end surface 67*a* is pressed by the blade 68. Consequently, the end surface 67*a* and the blade 68 are brought into tight contact with respect to each other, and the sealing member 67 comes completely into tight contact with the curved surface 70*a* of the holder 70.

As described above, in the developing device 4 in the present preferred embodiment, there are provided the first plane 71*a* along which the blade 68 for regulating the amount of the developer on the developing roller 44 is mounted to the casing 40 and the second plane 72*a* positioned upwardly of the first plane 71*a*. After having positioned the sealing member 67 so that the end surface 67*a* thereof is located between the first plane 71*a* and the second plane 72*a*, the blade 68 is mounted so as to press the end surface 67*a*.

The first plane 71*a* is determined to be the lower limit reference plane of the end surface 67*a*, and the second plane 72*a* is determined to be the upper limit reference plane of the end surface 67*a*. The sealing member 67 is positioned so that the end surface 67*a* is located between the first plane 71*a* and the second plane 72*a*. Consequently, at the time of assembly of the developing device 4, the positioning of the sealing member 67 can be achieved easily. Therefore, the positioning error of the sealing member 67 can be made constant even though it is mounted by an inexperienced operator. In particular, since the second plane 72*a* as the upper limit reference plane is provided in addition to the first plane 71*a* as the lower limit reference plane, the amount of projection of the end surface 67*a* from the first plane 71*a* is prevented from becoming too much. Therefore, the sealing member 67 pressed by the blade 68 is prevented from being deflected. Therefore, generation of a gap between the sealing member 67 and the curved surface 70*a* of the holder 70 is prevented, and hence leaking of the developer from the interior of the casing 40 is reliably prevented. In this manner, according to the configuration of the present preferred embodiment, the assembling accuracy of the developing device 4 is improved, and hence the assembling efficiency is also improved.

In particular, the first plane 71*a* and the second plane 72*a* are provided adjacent to the holder 70 to which the sealing member 67 is mounted. Therefore, the operator can locate the end surface 67*a* of the sealing member 67 easily. In other words, the sealing member 67 is moved upward and downward along the curved surface 70*a* of the holder 70 in the circumferential direction, whereby the end surface 67*a* is located with respect to the first plane 71*a* and the end surface 67*a* is located with respect to the second plane 72*a*. Therefore, positioning of the end surface 67*a* is facilitated even for an inexperienced operator. Variation in assembling accuracy can be reduced, and the assembling efficiency is also improved. The second plane 72*a* is formed along the upper surface of the rib 72 provided on the casing 40. Therefore, it can be molded by simply adding to the configuration of the casing 40 in the prior art. Therefore, the number of parts is prevented from increasing, and hence the manufacturing cost is not increased.

The arrangement of the holder 70 or the like is not limited to the preferred arrangement described above. The blade mounting member 71 and the rib 72 must simply be arranged adjacent to the holder 70. For example, the position of the blade mounting member 71 and the rib 72 with respect to the holder 70 may be exchanged. In other words, the blade mounting member 71 may be arranged so as to be adjacent to the curved surface 70*a* of the holder 70 and arranged outwardly of the device with respect to the holder 70, and the rib 72 may be arranged so as to be adjacent to the curved surface 70*a* of the holder 70. When viewed from the opening 40*a* on the casing 40, the holder 70 may be arranged on the rear side of the device. In particular, the shape and the arrangement of the rib 72 are not specifically limited. It may be any shape as long as the second plane 72*a* is formed along the upper surface of the rib 72 so as to enable the positioning of the end surface 67*a* of the sealing member 67.

Although the first plane 71*a* and the second plane 72*a* are integral with members of the casing 40, they may be separate members. In other words, when the first plane 71*a* and the second plane 72*a* are configured by separate members, the height can be changed according to the sealing member 67 and the blade 68.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. A developing device comprising;

a casing having a first plane and a second plane;

a sealing member arranged to seal an end of a developing roller and to prevent developer leaking from an interior of the casing; and a blade mounted along the first plane and arranged to regulate an amount of the developer on the developing roller, the second plane being positioned upwardly of the first plane; wherein the sealing member is mounted to the casing so that an end surface of the sealing member is positioned so as to be located between the first plane and the second plane; and the blade presses against the end surface of the sealing member.

2. The developing device according to claim 1, wherein the casing includes a holder to which the sealing member is mounted, and the first plane and the second plane are provided adjacent to the holder.

3. The developing device according to claim 2, wherein the casing includes a rib, and the second plane is located along an upper surface of the rib.

4. The developing device according to claim 2, wherein the holder has a curved surface, and an outer side surface of the sealing member is in tight contact with the curved surface.

5. The developing device according to claim 4, wherein the first plane circumferentially is located at an end of curved surface.

6. The developing device according to claim 1, further comprising caps mounted to respective ends of the developing roller, wherein the sealing member is in tight contact with the caps at the respective ends of the developing roller.

7. The developing device according to claim 6, wherein the sealing member extends along a circumferential surface of the cap.

8. The developing device according to claim 1, wherein the blade is longer than a longitudinal length of the developing roller and projects along the first plane toward the direction close to an outer surface of the developing roller.

9. The developing device according to claim 1, wherein the first plane and the second plane extend substantially parallel to each other.

10. An image forming device comprising:

a photosensitive drum, a charger arranged to charge the photosensitive drum, an exposure device arranged to form an electrostatic latent image on an outer surface of the charged photosensitive drum, a developing device arranged to develop the electrostatic latent image with a developer including toner, and a transfer device arranged to transfer the developed toner image to a recording paper, wherein;

the developing device includes a sealing member arranged to seal an end of a developing roller to prevent the developer from leaking from an interior of a casing;

the casing includes a first plane and a second plane, the first plane is provided with a blade arranged to regulate an amount of the developer on the developing roller, and the second plane is positioned upwardly of the first plane;

the sealing member is mounted to the casing so that an end surface thereof is located between the first plane and the second plane; and the blade presses against the end surface of the sealing member.

11. The image forming device according to claim 10, wherein the casing includes a holder to which the sealing member is mounted, and the first plane and the second plane are adjacent to the holder.

12. The image forming device according to claim 11, wherein the casing includes a rib, and the second plane is located at an upper surface of the rib.

13. The image forming device according to claim 11, wherein the holder includes a curved surface, and an outer side surface of the sealing member is in tight contact with the curved surface.

14. The image forming device according to claim 13, wherein the first plane circumferentially is located at an end of the curved surface.

15. The image forming device according to claim 10, wherein the developing roller includes caps mounted to respective ends thereof, and the sealing members are in tight contact with the caps at the respective ends of the developing roller.

16. The image forming device according to claim 15, wherein the sealing member extends along a circumference of the cap.

17. The image forming device according to claim 10, wherein the blade is longer than a longitudinal length of the developing roller and projects along the first plane toward the direction close to an outer surface of the developing roller.

18. The image forming device according to claim 10, wherein the first plane and the second plane extend substantially parallel to each other.

19. A method of assembling a developing device having a sealing member for sealing an end of a developing roller to prevent developer from leaking from an interior of a casing, comprising;

providing a first plane to which a blade for regulating the amount of developer on the developing roller is mounted to the casing and a second plane arranged upwardly of the first plane;

positioning the sealing member so that an end surface thereof is located between the first plane and the second plane; and mounting the blade so as to press against the end surface.

* * * * *